US005142113A

United States Patent [19]

Miyata

[11] Patent Number: 5,142,113

[45] Date of Patent: Aug. 25, 1992

[54] SWITCH

[75] Inventor: Muneyoshi Miyata, Tokyo, Japan

[73] Assignee: Mitsuku Denshi Kogyo Kabushiki Kaisha, Tokyo, Japan

[21] Appl. No.: 603,366

[22] Filed: Oct. 26, 1990

[30] Foreign Application Priority Data

Nov. 1, 1989 [JP] Japan ..... 1-285418
Dec. 18, 1989 [JP] Japan ..... 1-328722

[51] Int. Cl.[5] ..... H01H 21/82

[52] U.S. Cl. ..... 200/559; 200/573; 200/335; 200/459; 200/6 BB

[58] Field of Search ..... 200/535, 533, 558, 559, 200/573, 329, 332, 335, 290, 282, 433, 431, 438, 451, 459, 461, 283, 284, 343, 521, 534, 569, 574, 6 B, 6 BA, 6 BB

[56] References Cited

U.S. PATENT DOCUMENTS 1,909,641 5/1933 Watts ..... 200/559
4,059,738 11/1977 Mongeau ..... 200/6 B
4,070,555 1/1978 Carli ..... 200/6 BB X
4,177,367 12/1979 Tirone et al. ..... 200/535
4,311,884 1/1982 Henley et al. ..... 200/559 X
4,656,321 4/1987 Ruyten ..... 200/6 B X
4,975,548 12/1990 Brouilette et al. ..... 200/559 X

FOREIGN PATENT DOCUMENTS 1070726 12/1959 Fed. Rep. of Germany ..... 200/574
2621864 11/1977 Fed. Rep. of Germany ..... 200/559
3012107 10/1981 Fed. Rep. of Germany ... 200/159 R
960644 6/1964 United Kingdom ..... 200/438

*Primary Examiner*—Henry J. Recla
*Assistant Examiner*—Glenn T. Barrett
*Attorney, Agent, or Firm*—Oblon, Spivak, McClelland, Maier & Neustadt

[57] ABSTRACT

A switch capable of significantly reducing the number of parts therefor and permitting the manufacturing and assembling to be carried out with high efficiency. Only four parts consisting of a casing, a top plate or a bottom plate, a cam lever and a leaf spring each simplified in structure are required to construct the switch. The cam lever causes pressing force acting in a small magnitude on its lever section to be changed to pressing force of an increased magnitude acting on its cam section in a lever-like manner about a support shaft.

4 Claims, 9 Drawing Sheets

SWITCH

BACKGROUND OF THE INVENTION

This invention relates to a switch, and more particularly to a switch of which contacts are open and closed by depressing and releasing a lever section of a cam lever as in a conventional push button switch.

A switch is conventionally manufactured by separately manufacturing various parts of the switch such as a casing, a cam lever, a leaf spring and the like and then integrally assembling the parts into the switch using suitable means such as plastics molding, soldering or the like. Unfortunately, the plastics molding and soldering fail to provide the switch wit satisfactory precision. For example, the positional relationship between the leaf spring and the fixed contact is not made constant even when the parts are precisely manufactured, thus, there occurs non-uniformity in quality depending upon the switch. A fine adjustment operation proposed in order to eliminate such a problem is highly troublesome and requires much time and labor, therefore, the mass production of the switch renders the quality nonuniform, resulting in adversely affecting the performance of equipment for which the switch is used.

SUMMARY OF THE INVENTION

Accordingly, the present invention has been made in view of the foregoing disadvantage of the prior prior art.

Accordingly, it is an object of the present invention to provide a switch which is capable of significantly reducing the number of parts therefor.

It is another object of the present invention to provide a switch which is capable of permitting the manufacturing and assembling to be carried out with high efficiency.

It is a further object of the present invention to provide a switch which is capable of substantially reducing the manufacturing and assembling costs.

It is still another object of the present invention to provide a switch which is suitable for mass production while ensuring uniformity in quality of the switch.

It is yet another object of the present invention to provide a switch which is capable of exhibiting satisfactory performance and endurance.

In accordance with the present invention, there is provided a switch which comprises a cam lever including a support shaft, and a lever section and a cam section which are connected through the support shaft to each other at a predetermined angle and pivotally moved about the support shaft, fixed contacts, and a leaf spring contacted at one end thereof with one of the fixed contacts and inflectedly supported in a lever-like manner about a fulcrum comprising a projecting contact section of the one fixed contact or a projection arranged in proximity to the one fixed contact. The leaf spring is resiliently forcedly contacted at the other end thereof with the lower surface of the cam section of the cam lever or the lower surface of each of the cam section and support shaft.

Also, in accordance with the present invention, there is provided a switch which comprises a cam lever including a support shaft, and a lever section and a cam section which are connected through the support shaft to each other at a predetermined angle and pivotally moved about the support shaft, fixed contacts, and a leaf spring formed into an arcuate shape. The leaf spring is supported so as to keep one end thereof contacted with one of the fixed contacts. The leaf spring is resiliently forcedly contacted at the other end thereof with the lower surface of each of the cam section and support shaft of the cam lever positioned above the other of the fixed contacts or the lower surface of the cam section.

Further, in accordance with the present invention, there is provided a switch which comprises a small-sized lower open casing formed into a cubic shape and including a top wall provided on the inner surface thereof with fixed contacts each having a terminal projected from the casing and a spring holding projection; a bottom plate provided on the upper surface thereof with a shaft holding projection; a cam lever including a support shaft, and a lever section of a fan-like shape or the like and a cam section which are connected through the support shaft to each other at a predetermined angle and pivotally moved about the support shaft; and a leaf spring made of a conductive material. The leaf spring and cam lever are arranged in the casing and the bottom plate is fixedly mounted on the lower portion of the casing, so that the leaf spring is pressedly interposed between the bottom plate and the spring holding projection to keep one end of the leaf spring pressedly contacted with one of the fixed contacts and resiliently pressedly contact the other end of the leaf spring with the other of the fixed contacts and the lower surface of the cam section of the cam lever and the shaft holding projection pressedly supports the support shaft of the cam lever to cause the lever section of the cam lever to be upward pivotally projected from the top wall due to pressing force applied from the leaf spring to the cam section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a switch according to the present invention will be described hereinafter with reference to the accompanying drawings.

Figure 1A:
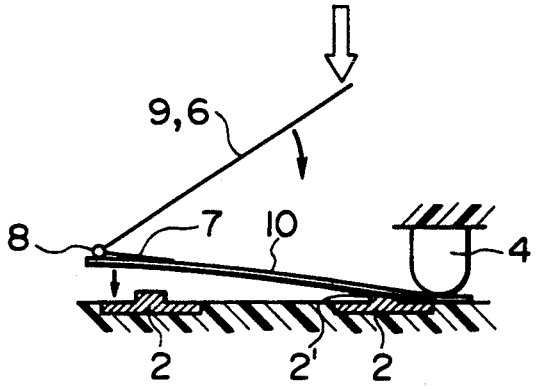
FIGS. 1(*a*) to 1(*c*) each are a fragmentary sectional view showing a basic construction of a switch according to the present invention.
Figure 1B:
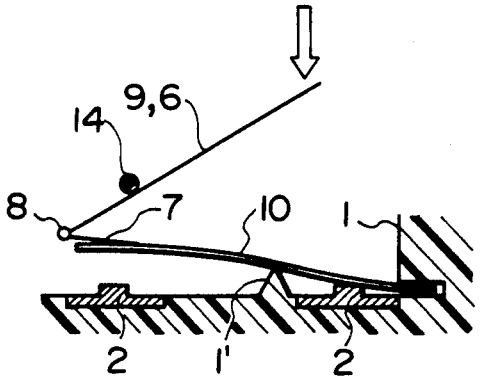
Figure 1C:
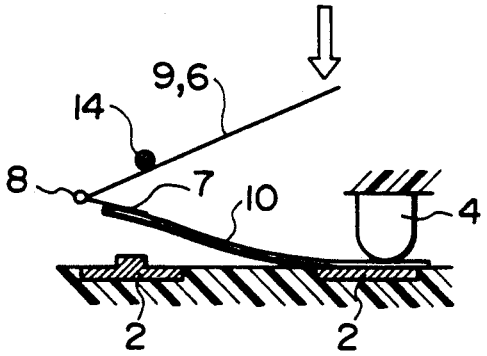

Generally speaking, a switch of the present invention is constructed in such a manner as shown in FIG. 1(*a*) or 1(*b*). The switch includes a cam lever 9 which comprises a lever section 6 and a cam section 7 which are arranged so as to be angularly connected through a support shaft 8 to each other at a predetermined angle of, for example, 40 degrees about the support shaft 8 and is pivotally movable about the support shaft 8. Also, the switch includes a leaf spring 10 of which one end is contacted with one of fixed contacts 2. The leaf spring 10 is inflectedly supported at the one end thereof in a lever manner about a fulcrum comprising a projecting contact section 2' of the fixed contact 2 or a projection 1' arranged in proximity to the fixed contact 2, so that the leaf spring 10 may be resiliently forcedly contacted at the other end thereof with either the lower surface of the cam section 7 of the cam lever 9 positioned above the other fixed contact or the lower surface of each of the cam section 7 and pivot shaft 8 of the cam lever 9.

Alternatively, in the switch of the present invention, as shown in FIG. 1(*c*), the leaf spring 10 may be previously formed into an arcuate shape. Such construction of the leaf spring exhibit the same function as described above with reference to FIG. 1(*a*) and 1(*b*).

More particularly, in the switch shown in FIG. 1(*a*), the leaf spring 10 is forcedly contacted at the one end thereof with the fixed contact 2 by means of a spring holding projection 4 or the like and inflectedly supported in a lever-like manner at the projecting contact section 2', resulting in the other end of the leaf spring 10 being forcedly contacted with the lower end of each of the pivot shaft 8 and cam section 7 of the cam lever 9.

In the switch shown in FIG. 1(*b*), the leaf spring 10 is fixedly supported at the one end thereof on a casing 1, contacted with the fixed contact 2, and supported in a lever-like manner at the projection 1' provided on the casing 1 in proximity to the contact 2 and acting as a fulcrum, so that the other end of the leaf spring 10 may be pressedly contacted with the lower surface of the cam section 7 of the cam lever 9. Also, the switch is provided with a stopper 14, which functions to regulate the pivotal movement of the lever section 6 in the upward direction. The stopper 14 may be arranged on a top plate 5 or the like.

In the switch shown in FIG. 1(*c*), the leaf spring 10 is formed into an arcuate shape in advance. The leaf spring 10 is fixedly supported at the one end thereof so that the other end thereof may be inflectedly lifted and then resiliently pressedly contacted with the lower surface of each of the cam section 7 and pivot shaft 8 of the cam lever.

Figure 2B:
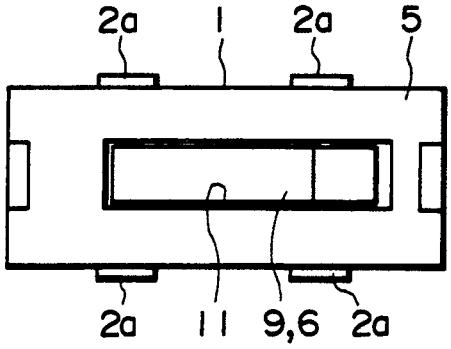
FIGS. 2(*a*) to 2(*c*) are a vertical sectional front elevation view, a plan view and a side elevation view each showing an embodiment of a switch according to the present invention, respectively.
Figure 2A:
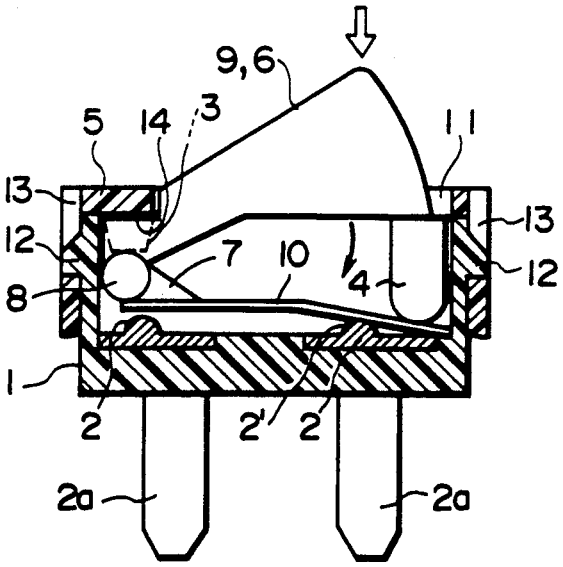
Figure 2C:
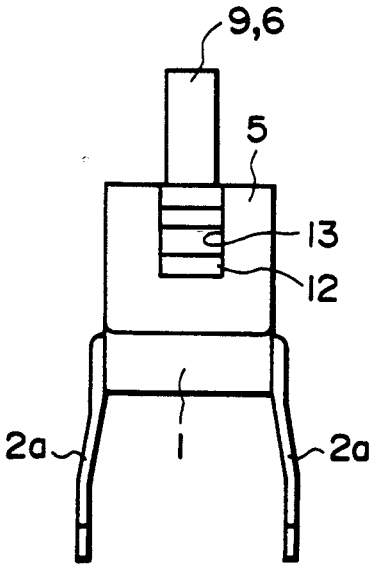
Figure 3C:
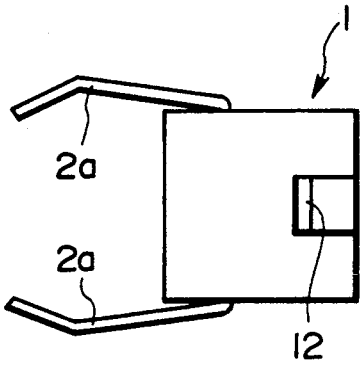
FIGS. 3(*a*) to 3(*c*) are a vertical sectional view, a plan view and a side elevation view each showing a casing of the switch shown in FIGS. 2(*a*) to 2(*c*), respectively.
Figure 3B:
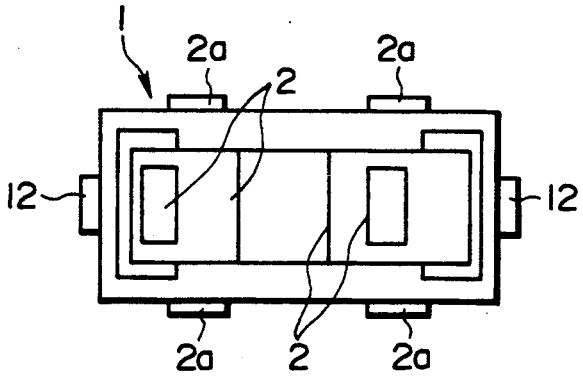
Figure 3A:
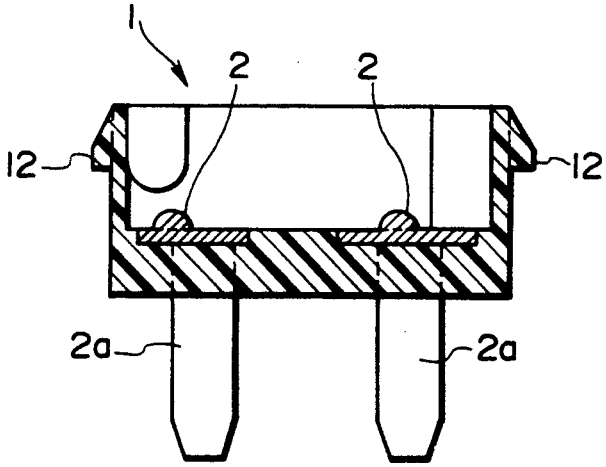
Figure 4B:
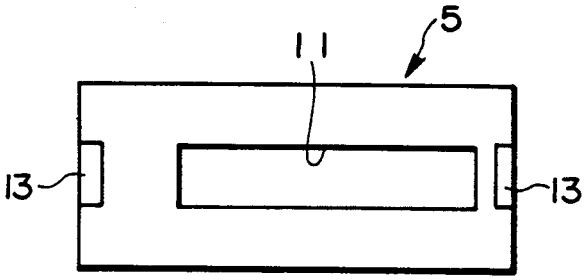
FIGS. 4(*a*) to 4(*d*) are a vertical sectional front elevation view, a plan view, a bottom view and a side elevation view each showing a top plate of the switch shown in FIGS. 2(*a*) to 2(*c*), respectively.
Figure 4D:
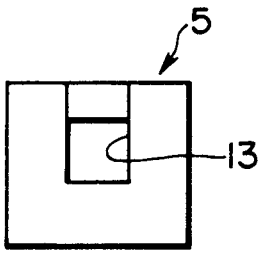
Figure 4A:
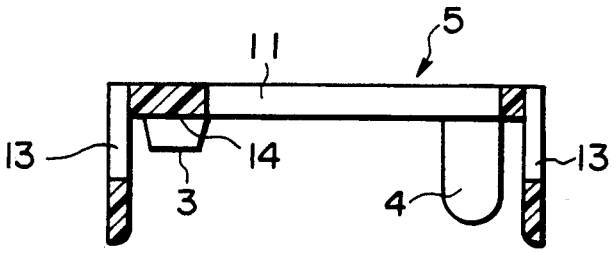
Figure 4C:
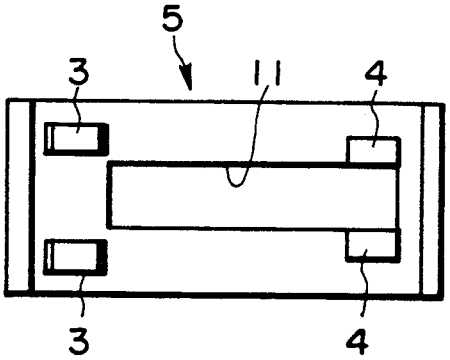
Figure 5B:
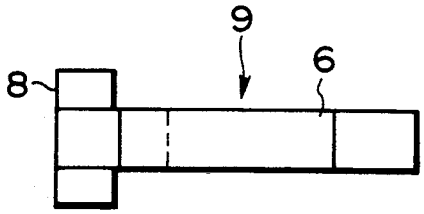
FIGS. 5(*a*) and 5(*b*) are a front elevation view and a plan view each showing a cam lever, respectively.
Figure 5A:
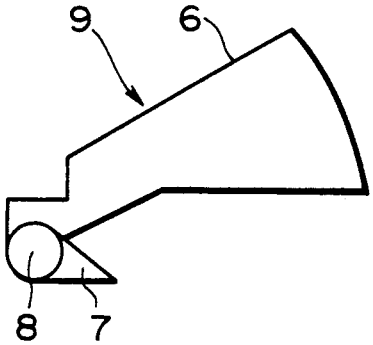

The switch of the present invention which is generally constructed as described above may be embodied in such a manner as shown in FIGS. 2(*a*) to 5(*b*). The embodiment shown in FIGS. 2(*a*) to 5(*b*) is constructed into a normal-open type switch wherein a switch body is housed in an insulating casing made of a plastic material or the like and contacts are normally open. The switch includes a small-sized casing 1 of a cubic shape or the like, fixed contacts 2 which are arranged on the inner bottom surface of the casing 1 and of which terminals 2*a* are outward projected from the casing 1, a top plate 5 which is provided on the lower surface thereof with a shaft holding projection 3 and a spring holing projection 4, a cam lever 9 including a lever section 6 formed into a suitable shape such as a fan-like shape or the like and a cam section 7 which are angularly connected through a support shaft 8 to each other so as to define a predetermined angle of, for example, 40 degrees therebetween about the support shaft 8, and a leaf spring 10 formed of a conductive material into a strip-like shape. The leaf spring 10 and cam lever 9 are arranged in the casing 1 and the top plate 5 is fixedly mounted on the upper portion of the casing 1 to cover it, so that the spring holding projection 4 presses one end of the leaf spring against one of the fixed contacts 2 while keeping the former contacted with the latter and resiliently forcedly contacts the other end of the leaf spring 10 with the lower surface of each of the support shaft 8 and cam section 7 of the cam lever 9 located above the other of the fixed contacts 2, and the shaft holding projection 3 pressedly holds the support shaft 8 of the lever 9 to cause the lever section 6 of the cam lever 9 to be outward upward projected through a slit 11 of the top plate 5 from the top plate.

In the switch of the embodiment constructed as described above, the top plate 5 may be fixedly mounted on the upper portion of the casing using a suitable means. For example, the mounting may be carried out by relative engagement between both. More specifically, the casing 1 is provided on both sides thereof with engagement projections 12, which are engaged with engagement apertures or recesses 13 correspondingly formed on both sides of the top plate 5.

The leaf spring 10, when it is pressedly held at the one end thereof through the spring holding projection 4 in the casing 1, may be inflectedly supported in a lever-like manner about the projecting contact section 2' acting as a fulcrum while contacting the one end with one of the fixed contacts 2, so that the other end of the leaf spring 10 is inflectedly lifted above the other fixed contact 2, to thereby be resiliently forcedly contacted with the lower surface of each of the support shaft 8 and cam section 7 of the cam lever 9 to resiliently force the cam section 7. This causes the lever section 6 to be upwardly pivotally moved about the support shaft 8, resulting in the section 6 being kept upward projected from the top plate 5.

The top plate 5 may be provided at a part thereof with the stopper 14 acting for regulating the upward pivotal movement of the cam lever 9, as required.

Figure 6A:
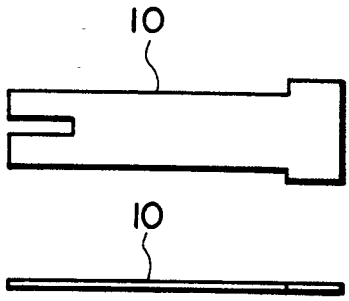
FIGS. 6(*a*) and 6(*b*) are a front elevation view and a plan view each showing a leaf spring, respectively.
Figure 6B:
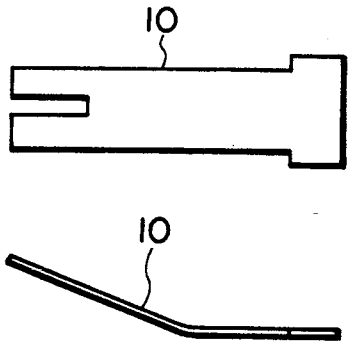

Alternatively, the leaf spring 10 may be previously formed into an arcuate shape as shown in FIG. 6(*b*). Such a configuration permits the leaf spring to exhibit the same function and advantage as described above.

The leaf spring 10 may be formed into a strip-like shape. It may be made of a plurality of leaf spring elements for the purpose of optimizing its elasticity or resiliency in response to pressing force applied from the lever section 6 of the cam lever 9 to the leaf spring 10 and improving the endurance of the leaf spring 10. The use of a single thin spring element for the leaf spring 10 would fail to cause it to exhibits satisfactory elastic properties, whereas the use of a single thick spring element would deteriorate the endurance of the leaf spring in spite of causing it to exhibit much elastic force. Thus, it is preferably made of a plurality of thin leaf spring elements by laminating.

In the switch of the illustrated embodiment described above, the depression of the lever section 6 causes it to be downward pivotally moved about the support shaft 8 and concurrently causes the cam section 7 to be pivotally moved, so that the other end of the leaf spring 10 may be downwardly deflected. This causes the other end of the leaf spring 10 to be contacted with the fixed contact 2, leading to electrical connection between the fixed contacts 2 through the leaf spring 10. This results in the switch being turned on.

Then, when the lever section 6 is released from the depression, the cam section 7 is upwardly forced by the elastic restoring force of the leaf spring 10, so that the lever section 6 may be returned to the original position due to its upward pivotal movement to cause the other end of the leaf spring 10 to be separated from the fixed contact 2, resulting in the switch being turned off.

In assembling of the switch wherein the switch body is arranged in the casing, the leaf spring 10 and cam lever 9 are disposed in order in the casing 1 and then the top plate 5 is fixedly mounted on the casing 1 by a one-touch operation by fittedly engaging the projections 12 provided on the both sides of the casing 1 with the apertures 13 of the top plate 5.

Such mounting causes the spring holding projection 4 to pressedly hold the one end of the leaf spring 10, to thereby not only pressedly contact the leaf spring 10 with the one of the fixed contacts 2 but cause the other end of the leaf spring 10 positioned above the other fixed contact 2 to be upwardly deflected to resiliently forcedly contact the other end with the lower surface of each of the support shaft 8 and cam section 7 of the cam lever 9, resulting in upwardly forcing the cam section 7. This causes the lever section 6 of the cam lever 9 to be upwardly pivotally moved about the support shaft 8, so that the lever section 6 may be kept projected through the slit 11 from the top 5. This leads to turning-off of the switch.

Thus, in the switch of the illustrated embodiment, the depression of the lever section 6 through the slit 11 of the top plate 5 and the release of the lever section from the depression cause the switch to be turned on and turned off, respectively.

Figure 7B:
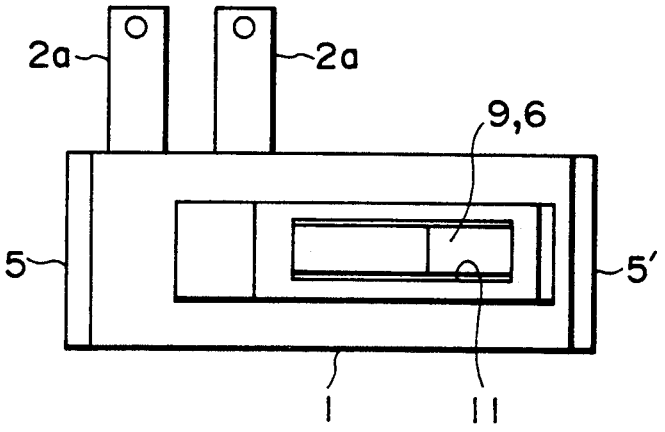
FIGS. 7(*a*) to 7(*c*) are a vertical sectional view, a plan view and a side elevation view each showing another embodiment of a switch according to the present invention, respectively.
Figure 7C:
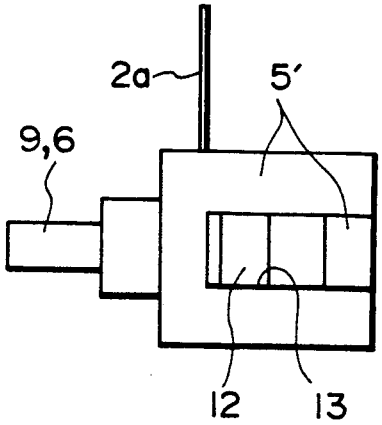
Figure 7A:
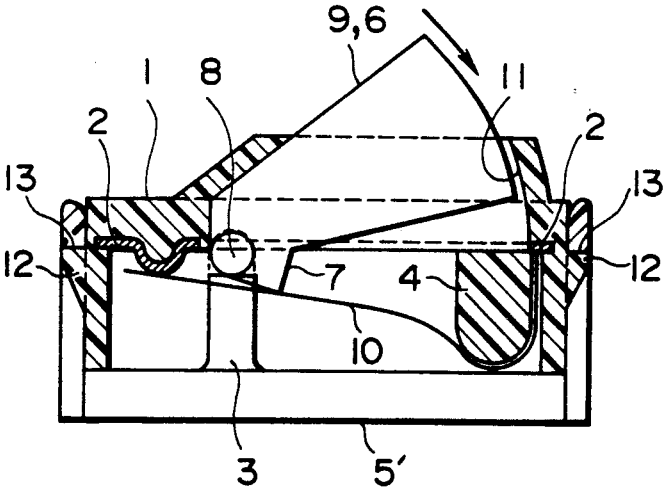
Figure 8:
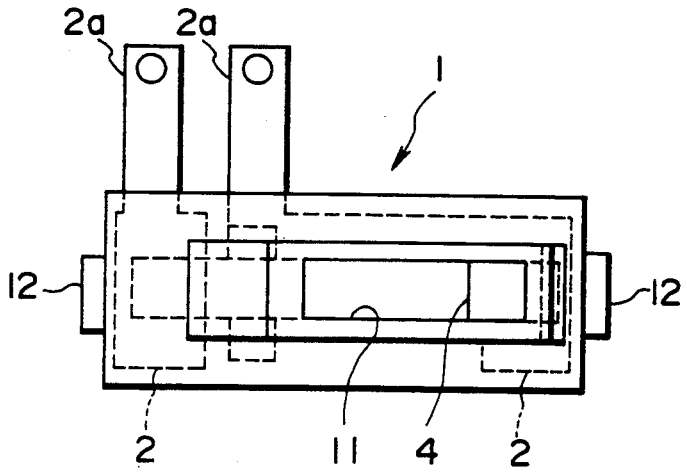
FIGS. 8(*a*) to 8(*c*) are a vertical sectional front elevation view, a plan view and a side elevation view showing a casing, respectively.
Figure 8:
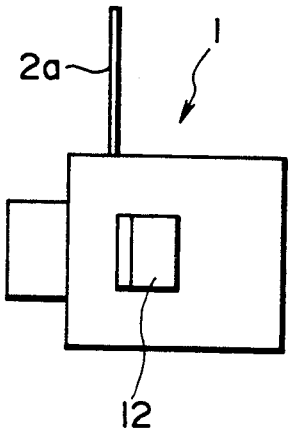
Figure 8:
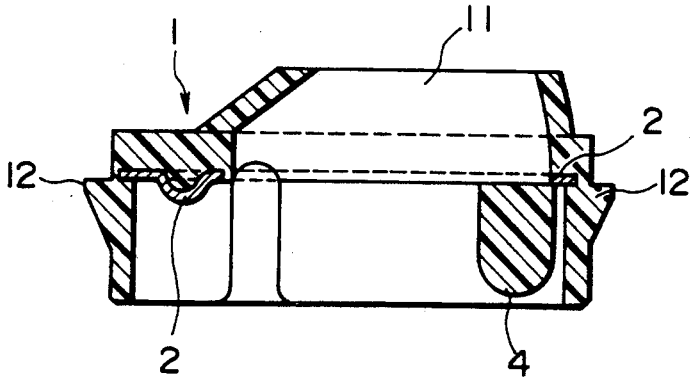
Figure 9B:
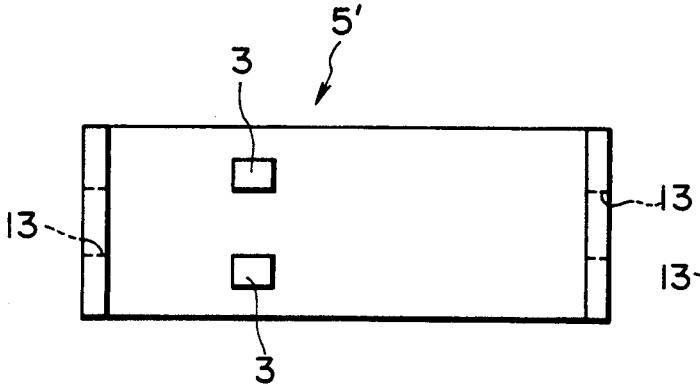
FIGS. 9(*a*) to 9(*c*) are a vertical sectional front elevation view, a plan view and a side elevation view each showing a bottom plate, respectively.
Figure 9C:
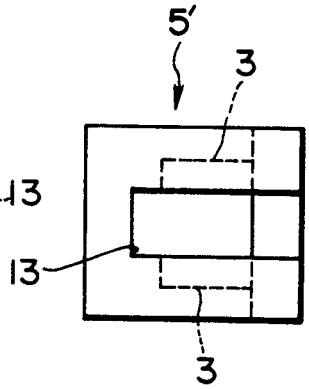
Figure 9A:
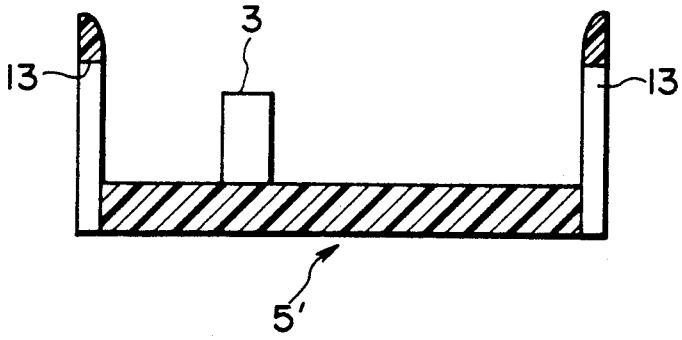
Figure 10B:
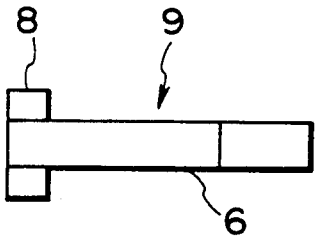
FIGS. 10(*a*) and 10(*b*) are a front elevation view and a plan view each showing a cam lever, respectively.
Figure 11B:
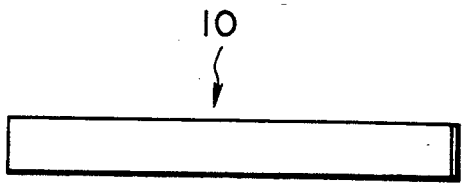
FIGS. 11(*a*) and 11(*b*) are a front elevation view and a plan view each showing a leaf spring, respectively.
Figure 10A:
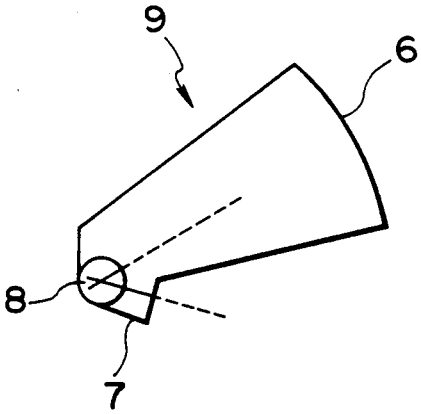
Figure 11A:
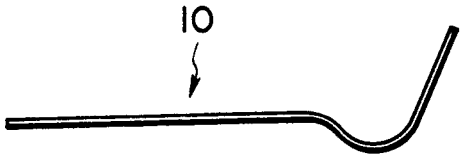

FIGS. 7(*a*) to 11(*b*) show another embodiment of a switch according to the present invention, which is constructed into a normal-closed type switch, wherein a switch body is arranged in an insulating casing made of a plastic material or the like and contacts are normally closed. The switch includes a small-sized casing 1 formed into a cubic shape or the like. The casing 1 includes a top wall which is provided on the inner surface thereof with fixed contacts 2 having terminals 2*a* outwardly projected from the casing 1, as well as a spring holding projection 4. The switch also includes a bottom plate 5' which is provided with a shaft holding projection 3, a cam lever 9 including a lever section 6 formed into a suitable shape such as a fan-like shape or the like and a cam section 7 which are angularly connected through a support shaft 8 to each other so as to define a predetermined angle of, for example, 40 degrees therebetween about the support shaft 8, and a leaf spring 10 formed of a conductive material into a strip-like shape. The leaf spring 10 and cam lever 9 are disposed in the casing 1 and then the bottom plate 5' is fixedly mounted on the lower portion of the casing 1, during which the leaf spring 10 is pressedly interposed at one end thereof between the bottom plate 5' and the spring holding projection 4 to keep one end of the leaf spring 10 pressedly abutted against one of the fixed contacts 2 and is upwardly inflected thereof to resiliently forcedly contact the other end with the other fixed contact 2 and the lower surface of the cam section 7 of the cam lever 9. Also, the support shaft 8 of the cam lever 9 is upward pressedly supported on the shaft holding projection 3, so that the lever section 6 of the cam lever 9 may be upward pivotally moved by means of pressing force of the leaf spring 10 applied to the cam section 7, resulting in being upwardly projected through a slit 11 from the top wall of the casing 1.

The bottom plate 5' may be fixedly mounted on the lower portion of the casing 1 using a suitable means as in the embodiment shown in FIGS. 2(*a*) to 6(*b*). For example, the casing 1 is provided on both sides thereof with engagement projections 12, which are engaged with engagement apertures or recesses 13 correspondingly formed on both sides of the bottom plate 5'.

The leaf spring 10 is preferably constructed in such a manner that when it is pressedly interposed at the one end thereof between the spring holding projection 4 and the bottom plate 5' in the casing 1, the other end of the leaf spring 10 is upwardly inflected while contacting the one end with one of the fixed contacts 2, so that the other end of the leaf spring 10 is inflectedly lifted, to thereby be resiliently forcedly abutted against the lower surface of each of the fixed contact 2 and the cam section 7 of the cam lever 9 to resiliently force the cam section 7. This causes the lever section 6 to be upwardly pivotally moved about the support shaft 8, resulting in the section 6 being kept upward projected from the top wall of the casing 1.

For this purpose, for example, the leaf spring 10 is previously formed into a dog-legged shape or the like so that the other end of the leaf spring 10 may be upwardly inflected due to force at which the one end of the leaf spring 10 is pressedly interposed between the spring force projection 4 and the bottom plate 5'.

The assembling of the switch of the illustrated embodiment may be carried out in such a manner that the cam lever 9 and leaf spring 10 are disposed in turn in the casing 1 and then the bottom plate 5' is fixedly mounted on the casing 1 by a one-touch operation by engagedly fitting the engagement apertures 13 of the bottom plate 5' on the engagement projections 12 of the casing 1.

Such mounting causes the one end of the leaf spring 10 to be pressedly held between the spring holding projection 4 of the casing 1 and the bottom plate 5', to thereby not only pressedly contact the leaf spring 10 with the one of the fixed contacts positioned above the other fixed contact 2 but cause the other end of the leaf spring 10 to be upwardly inflected to resiliently forcedly contact the other end with the lower surface of the cam section 7 of the cam lever 9 and the other fixed contact 2, resulting in upwardly forcing the cam section 7. This causes the lever section 6 of the cam lever 9 to be upwardly pivotally moved about the support shaft 8, so that the lever section 6 may be kept projected through the slit 11 from the top wall of the casing 1. This results in the switch being turned on.

In the switch of the illustrated embodiment described above, the depression of the lever section 6 upward projecting from the top wall of the casing 1 causes it to be downwardly pivotally moved about the support shaft 8 and concurrently causes the cam section 7 to be pivotally moved, so that the other end of the leaf spring 10 pressedly contacted with the cam section 7 may be downwardly inflected. This causes the other end of the leaf spring 10 to be released from the fixed contact 2, resulting in releasing electrical connection between the fixed contacts 2 through the leaf spring 10. Thus, the switch is turned off.

Then, the lever section 6 is released from the depression, the cam section 7 is upward forced by elastic restoring force of the leaf spring 10, so that the lever section may be returned to the original position due to its upward pivotal movement to cause the other end of the leaf spring 10 to be contacted with the fixed contact 2, resulting in the switch being turned on.

As can be seen from the foregoing, in the switch of the present invention constructed as described above, the cam lever 9 causes pressing force acting in a small magnitude on the lever section 6 to be changed to pressing force of an increased magnitude acting on the cam section 7 in a lever-like manner about the support shaft 8. Thus, the present invention permits the switching operation to be positively accomplished using pressing force of a small magnitude. This enables a leaf spring exhibiting relatively large elastic force to be used, resulting in the switching operation being accurately carried out without chattering or the like.

A leaf spring which can exhibit large elastic force and satisfactory endurance may be formed of a plurality of relatively thin leaf spring elements by laminating.

Only four parts consisting of the casing, top plate or bottom plate, cam lever and leaf spring each simplified in structure are required to construct the switch of the present invention. Thus, the present invention significantly reduces the number of parts. Also, the switch of the present invention can be easily assembled because it is merely required to dispose the leaf spring and cam lever in the casing and then fittedly mount the top plate or bottom plate on the casing by a one-touch operation. Thus, the present invention substantially reduces costs for manufacturing and assembling the switch and accomplishes the manufacturing and assembling with high efficiency, to thereby advantageously provide a switch highly small-sized or miniaturized.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A switch comprising a housing;

a cam lever positioned within said housing and including a support shaft, a lever section and a cam section, said lever section and said cam section being connected to each other through said support shaft at a predetermined angle and pivotally moved within said housing about said support shaft;

a pair of fixed contacts positioned within said housing; and a leaf spring contacted at one end thereof with one of said fixed contacts and inflectedly supported at said one end in a lever-like manner about a fulcrum comprising a projecting contact section of said one fixed contact;

said leaf spring being resiliently forcedly contacted at the other end thereof with both a lower surface of said cam section and a lower surface of said support shaft and the other of said fixed contacts being positioned within said housing such that it contacts the other end of said leaf spring when said leaf spring is forced into contact by said cam lever.

2. A switch as defined in claim 1, wherein said housing further comprising a top plate having a lower surface, the lower surface of said top plate having a shaft holding projecting and a spring holding projection; and a casing defining a small-sized cubic shape;

said fixed contacts being arranged on an inner bottom surface of said casing and including terminals which outwardly project from said casing;

said leaf spring being made of a conductive material;

said leaf spring and cam lever being arranged in said casing and said top plate being fixedly mounted on an upper portion of said casing, so that said spring holding projection pressedly supports one end of said leaf spring so as to keep said leaf spring contacted with one of said fixed contacts and causes the other end of said leaf spring to be elastically forcedly contacted with both the lower surface of said cam section and the lower surface of said support shaft of said cam lever, and said shaft holding projection pressedly supports said support shaft of said cam lever to cause said lever section of said cam lever to be upwardly projected from said top plate.

3. A switch as defined in claim 2, where said top plate is mounted on the upper portion of said casing through relative engagement carried out by fitting an engagement projection means provided on one of said casing and top plate in an engagement aperture means provided at the other of said casing and top plate.

4. A switch as defined in claim 2, wherein said leaf spring comprises a plurality of laminated leaf spring elements each formed into a strip-like shape;

said leaf spring being arranged in such a manner that the other end thereof is upwardly inflected in a lever-like manner about said fulcrum comprising said projecting contact section of said fixed contact so that when said spring holding projection pressedly supports said leaf spring, said leaf spring is upwardly inflected at the other end thereof above the other fixed contact to be resiliently forcedly contacted at the other end thereof with both the lower surface of said support shaft and the lower surface of the cam section of said cam lever while being contacted at the one end thereof with said one fixed contact.

* * * * *

UNITED STATES PATENT AND TRADEMARK OFFICE

CERTIFICATE OF CORRECTION

PATENT NO. : 5,142,113

DATED : August 25, 1992

INVENTOR(S) : Muneyoshi Miyata

It is certified that error appears in the above-identified patent and that said Letters Patent is hereby corrected as shown below:

On Title Page:

Item [30], the Foreign Application Priority Data is incorrect, should be as follows: --Nov. 1, 1989 [JP] Japan.....1-285418

Dec. 19, 1989 [JP] Japan...1-328722--.

Signed and Sealed this

Fifth Day of October, 1993

*Attest:*

*Attesting Officer*

Bruce Lehman

BRUCE LEHMAN

*Commissioner of Patents and Trademarks*